United States Patent [19]

Soiron et al.

[11] 4,066,395

[45] Jan. 3, 1978

[54] PROCESS FOR DYEING OR PRINTING AROMATIC POLYAMIDE FIBRES

[75] Inventors: Charles Soiron; Karlheinz Keller, both of Riehen, Switzerland

[73] Assignee: Ciba-Geigy Corporation, Ardsley, N.Y.

[21] Appl. No.: 635,527

[22] Filed: Nov. 26, 1975

[30] Foreign Application Priority Data

Dec. 2, 1974 Switzerland ..... 15958/74

[51] Int. Cl.[2] ..... D06P 5/04

[52] U.S. Cl. ..... 8/169; 8/89 R; 8/173; 8/177 AB; 8/178 A

[58] Field of Search ..... 8/169, 173, 177 AB, 8/178 A, 89 R

[56] References Cited

U.S. PATENT DOCUMENTS

| | | | |
|---|---|---|---|
| 3,342,542 | 9/1967 | Morf et al. | 8/173 |
| 3,674,420 | 7/1972 | Sabers | 8/173 |
| 3,756,773 | 9/1973 | Isharani | 8/173 |
| 3,820,952 | 6/1974 | Delian et al. | 8/173 |
| 3,843,322 | 10/1974 | Streck | 8/169 |
| 3,860,392 | 1/1975 | Renault et al. | 8/173 |
| 3,925,016 | 12/1975 | Haase | 8/173 |
| 3,932,128 | 1/1976 | Beaulieu | 8/169 |
| 3,945,793 | 3/1976 | Corbishley et al. | 8/173 |

FOREIGN PATENT DOCUMENTS

| | | |
|---|---|---|
| 2,105,774 | 8/1971 | Germany. |
| 1,277,434 | 6/1972 | United Kingdom. |

OTHER PUBLICATIONS

Sisley et al., Encyclopedia of Surface Active Agents, Chem. Publ. Co. Inc., 1952, p. 44.

*Primary Examiner*—William E. Schulz
*Attorney, Agent, or Firm*—Edward McC. Roberts; Prabodh I. Almaula

[57] ABSTRACT

A process for dyeing or printing aromatic polyamide fibres with cationic dyes in aqueous medium, wherein the medium contains a. a carrier which contains no ketone-forming carbonyl groups, and b. an anionic assistant.

The process of the invention is especially suitable to obtain wilt cationic dyes dyeings having a color yield of 2 to 10 times greater than that obtained by using the same dye liquor but without the addition of any anionic assistant.

15 Claims, No Drawings

PROCESS FOR DYEING OR PRINTING AROMATIC POLYAMIDE FIBRES

The present invention provides a process for dyeing or printing aromatic polyamide fibres with cationic dyes, the dye liquor or printing paste suitable for carrying out this process, and also the aromatic polyamide fibres dyed or printed by this process.

A process for dyeing or printing aromatic polyamide fibres which can be dyed with cationic dyes is disclosed in Swiss Patent Application No. 541,662. This process comprises treating the fibres at a temperature of at least 100° C, preferably at 120° to 135° C, with a cationic or disperse dye in aqueous medium and in the presence of a carrier of formula

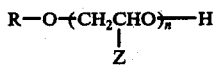

(1)

wherein R represents a phenyl group or advantageously a phenyl group which is substituted by chlorine, Z represents hydrogen or the methyl group, and $n$ is an integer from 1 to 3, and wherein each Z independently can represent hydrogen or the methyl group when $n$ is 2 or 3.

A novel process has now surprisingly been discovered which makes it possible to obtain with cationic dyes dyeings that are at least twice as strong if the dye liquor additionally contains an anionic assistant, preferably an anionic surfactant. Furthermore, it is possible to dye with advantage at low temperature with this dye liquor.

Accordingly, the invention provides a novel process for dyeing or printing aromatic polyamide fibres with cationic dyes in aqueous medium, wherein the medium contains in addition to the dye a. a carrier which contains no ketone-forming carbonyl groups, and b. an anionic, preferably surface-active, assistant.

The preferred fibres for the process of this invention are derived from the aromatic polyamides described in detail hereinafter. These aromatic polyamides have an inherent viscosity of at least 0.6 in concentrated sulphuric acid at 30° C and a melting point of at least 300° C. These polyamides possess structural units of formula

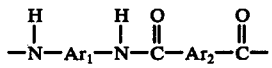

(2)

wherein $Ar_1$ and $Ar_2$, which can be the same or different, represent substituted or unsubstituted divalent aromatic groups, and the carboxy amide bonds which effect a chain lengthening are not in ortho-position to each other or to bonds which link two aromatic rings direct or through other members to aromatic rings, and the substituents that may be present in the aromatic rings are groups that do not react with amino or halide groups during the polymerisation, and the total number of carbon atoms in a substituent which is attached to any aromatic ring does not exceed 9, with the proviso that at least 10 molar percent by weight of the $Ar_1$ groups and at least 10 molar percent by weight of the $Ar_2$ groups can be replaced by non-aromatic groups. Preferably, however, the polyamide is "wholly aromatic", i.e. none of the $Ar_1$ or $Ar_2$ radicals are replaced by non-aromatic radicals. It is also preferred that the polyamide has an inherent viscosity of at least 0.8.

The aromatic polyamide fibres derived from poly-(metaphenylene-isophthalamide) are particularly preferred. An example of such a polyamide fibre which is commercially obtainable and which yields particularly advantageous results when the process of the present invention is applied thereto is one that is known under the registered trademark "NOMEX" ® (Du Pont), for example Nomex type 430, 450 or 454.

The textile material to be dyed can be in different stages of processing, for example loose material, yarn or piece goods, such as knitted or woven fabric.

Cationic dyes suitable for the process of the invention can belong to various classes of dye. In particular they comprise the customary salts, for example chlorides, sulphates or metal halides, for example zinc chloride double salts, of cationic dyes whose cationic character derives for example from a carbonium, oxonium, sulphonium or, above all, ammonium group. Examples of such chromophoric systems are azo dyes, primarily monoazo or hydrazone dyes, diphenylmethane, triphenylmethane, methine or azomethine dyes, cumarin, ketone-imine, cyanine, xanthene, azine, oxazine or thiazine dyes. Finally, it is also possible to use dye salts of the phthalocyanine or anthraquinone series with an external onium group, for example an alkylammonium or cycloammonium group and also benzo-1,2-pyrane dye salts which contain cycloammonium groups. Mixtures of such dyes can also be used according to the invention.

By dyes are also meant in this condition cationic fluorescent brighteners, for example those of the methine, azomethine, benzimidazole, benzoxazolyl, stilbene, oxazine, coumarin, benzocumarin, naphthacumarin, naphthalic imide, pyrazine or pyrazoline series.

The amounts in which the cationic dyes or fluorescent brighteners are used according to the invention can vary within wide limits, depending on the desired depth of shade. In general, amounts from 0.01 to 10 percent by weight of dye, or 0.01 to 1.0 percent by weight of fluorescent brightener, have proved advantageous.

As component (a), the carriers conventionally used in the dyeing industry that contain no ketone-forming carbonyl groups >C—CO—C< are suitable. These are, for example, benzene derivatives, for example diphenyl, chlorinated benzenes, xylenes or naphthalenes. Aromatic carboxylic acid esters are advantageously used as carriers that do not contain ketone-forming carbonyl groups, for example alkylbenzoates, aralkylbenzoates, salicylates or salicylate adducts, for example butyl-, benzyl-, cresyl- or phenylbenzoate, methylsalicylate, phenyl-o-(2-hydroxyethoxy)-benzoate or monobenzylphthalate. In particular, however, an aromatic glycol ether compound of formula (1), preferably in combination with benzyl alcohol, is used as component (a). The benzyl alcohol can advantageously be used in an amount of 20 to 50% and especially of 20 to 30% by volume, referred to the total volume of the mixture of benzyl alcohol and the glycol ether compound of formula (1).

The glycol ether compounds of formula (1) can be obtained, for example, by reacting an unsubstituted or chlorine-substituted phenol with 1 to 3 moles of either ethylene oxide or propylene oxide or by reacting this phenol compound with 1 to 3 moles of a mixture of ethylene oxide and propylene oxide.

Preferred glycol ether compounds of formula (1) are p-chlorophenoxyethanol, m-chlorophenoxyethanol, o-chlorophenoxyethanol, phenoxyethanol, 2,4- or 2,6-dichlorophenoxyethanol, 2,4,5-trichlorophenoxyethanol, 1-(2,4-dichlorophenoxy)-propane-2-ol or mixtures of these glycol ethers. Particularly satisfactory results are obtained with an aromatic glycol ether which is formed by reacting 1 mole of ethylene oxide per mole of a mixture that contains 20 percent by weight of o-chlorophenol and 80 percent by weight of p-chlorophenol.

Component (a) is used in general in amounts of 1 to 50 g/l of liquor, preferably 5 to 30 g/l of liquor.

In addition to dye or fluorescent brightener and component (a), the dye liquor contains an anionic assistant as component (b).

Particularly suitable anionic assistants are surfactants which contain sulphuric acid ester groups or sulphonic acid groups and which are used as free acids or preferably in the form of their salts, for example alkali metal salts, primarily sodium salts or especially ammonium or amine salts. As component (b) there are used, for example, alkali metal salts of fatty acids of 8 to 22 carbon atoms, salts of fatty sulphuric acid alkyl esters, alkyl-, alkylaryl- and aralkylsulphonates, alkylthiosulphates, alkylphosphates and alkylpyrophosphates the alkyl moieties of which contain in each case 8 to 22 carbon atoms. Preferably the following anionic surface-active assistants are used, as free acids or in the form of their alkali metal, ammonium or amine salts:
fatty alcohol sulphates of 8 to 22 carbon atoms, alkylnaphthalenesulphonates containing alkyl groups of altogether 8 to 22 carbon atoms, for example dibutylnaphthalenesulphonate, dodecyl-diphenyl ether disulphonate, sulphosuccinic acid alkyl esters containing alkyl groups of altogether 8 to 22 carbon atoms, for example dioctylsulphosuccinate, or sulphonated castor oil. It is also possible to use dinitrobenzenesulphonate as component (b).

Particularly suitable sulphates and sulphonates are an amine salt of a sulphonated long-chain fatty alcohol, dibutylnaphthalenesulphonate, dodecyl-diphenyl ether disulphonate, dioctylsulphosuccinate or sulphonated castor oil.

The anionic assistants are preferably used in an amount of 0.1 to 5 g/l of liquor.

The dye liquors or printing pastes can contain in addition inorganic or organic acids and/or water-soluble salts thereof, for example sulphuric acid, phosphoric acid, ammonium acetate, ammonium sulphate, alkyl- or arylsulphonic acid, lactic acid, chloroacetic acid, oxalic acid and, preferably, formic or acetic acid. These compounds are used preferably in amounts of 0.25 to 5 percent by weight, referred to the total weight of the fibres. They are used primarily to adjust the pH of the dye liquors or printing pastes. Usually the pH is 2.5 to 7, preferably 3 to 5.

The dye liquors or printing pastes can also contain further additives, for example those that influence the properties of the material to be dyed, for example antistatic agents, antioxidants, antimicrobial agents, additives for providing a flameproof finish or for increasing the hydrophilic properties, fabric softeners, and dirt, water and oil repellents.

The process of the present invention is preferably carried out by an exhaustion process.

The temperature at which the dyeing is effected is at least 50° C and is normally not higher than 140° C. Preferably it is in the range of 80° to 130° C and most preferably of 80° to 98° C. The dyeing time is normally 20 to 120 minutes.

If dyeing is effected by an exhaustion process, components (a) and (b) are added direct to the dyebath and the fibrous material is then immersed in the aqueous liquor. The dyed material is subsequently rinsed and dried. The liquor ratio can be chosen within a wide range, for example 1:1 to 1:100, preferably 1:10 to 1:50.

The process according to the invention can also be carried out by a printing or padding process, wherein the thickened liquor, which contains dye, components (a) and (b) as well as any further additives, is printed or padded onto the fibres, preferably at a temperature between 10° and 40° C. The padded or printed material is then subjected to a heat treatment, for example steaming, preferably at temperatures of 98° to 105° C and superatmospheric pressure, advantageously for 10 to 30 minutes.

The process according to the invention effects an outstanding colour yield on the dyed material. If the normal dyeing is taken as a colour strength of 100%, then values between 200 and 1000% are obtained with the novel process, i.e. the colour yield is 2 to 10 times greater than that obtained by using the same dye liquor, but without the addition of any anionic assistant, and otherwise carrying out the process under the same conditions.

Furthermore, the process of this invention makes it possible to apply lower dyeing temperatures, for example 30° C lower, and/or shorter dyeing times than in the known dyeing processes in which no anionic assistant is used. For example, the colour yield when dyeing at 98° C is better than in the known processes carried out at 130° C.

Since the process according to the invention makes it possible to dye at temperatures below 100° C with good colour yields, and since no pressure dyeing machines are required, it is of wider applicability than the known processes.

The fastness properties of the dyeings obtained correspond to those of dyeings that are obtained by the known dyeing processes.

The following Examples illustrate the invention, the percentages being by weight, referred to the material to be dyed.

EXAMPLE 1

An aqueous dye liquor of the following composition is prepared: 4% of the blue dye of formula

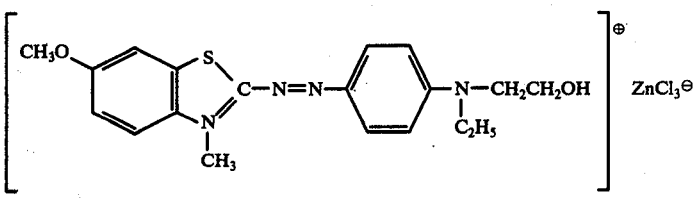

8 g/l of a mixture of 75 percent by volume of monochlorophenoxyethanol and 25 percent by volume of benzyl alcohol and 2 g/l of dioctyl sulphosuccinate. The pH is adjusted to 3 with formic acid. The monochlorophenoxyethanol is the reaction product of 1 mole of ethylene oxide and 1 mole of a mixture that contains 20% of o-chlorophenol and 80% of p-chlorophenol. At 60° C textile material of aromatic polyamides (NOMEX® 454) is put into this dye liquor (liquor ratio 1:20). The temperature is then raised to 98° C in the course of 30 minutes and dyeing is performed for 60 minutes at this temperature.

The material is subsequently rinsed for 15 minutes at 80° C with an aqueous liquor that contains 1% of a non-inonogenic detergent and 0.5% of acetic acid (80%), and dried. A blue textile material is obtained which is markedly more strongly coloured (colour strength 315%) than if the material is dyed at 98° C or also at 130° C with the same liquor, but without the addition of dioctyl sulphosuccinate (colour strength 100%).

If the above procedure is repeated, but using a dye liquor that contains instead of 2g/l of dioctyl sulphosuccinate the same amount of an amine salt of a sulphonated long-chain fatty alcohol, dodecyl-diphenyl ether disulphonate or sulphonated castor oil, the colour strengths reported in the table are obtained.

Table

| Anionic assistant | Colour strength in % |
|---|---|
| fatty alcohol sulphate | 380 |
| dodecyl-diphenyl ether disulphonate | 250 |
| sulphonated castor oil | 250 |

EXAMPLE 2

The procedure of Example 1 is repeated using instead of the dye liquor described therein an aqueous liquor which contains 4% of the red dye of formula

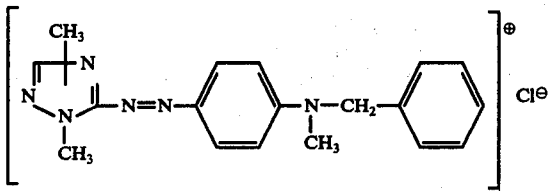

8 g/l of phenylbenzoate and 2 g/l of dibutylnaphthalene sulphonate and the pH of which is adjusted to 3 with formic acid. A red textile material is obtained with a colour strength of 925%.

A dyed textile material with a colour strength of 100% is obtained by carrying out the above procedure, but using a dye liquor without dibutylnaphthalene sulphonate.

EXAMPLE 3

An aqueous dye liquor which contains 4% of the blue dye of Example 1, 8 g/l of the carrier mixture of Example 1 and 1 g/l of dibutylnaphthalene sulphonate, and whose pH is adjusted to 3 with formic acid, is prepared in a dyeing apparatus. Textile material of aromatic polyamides (NOMEX® 454) is put into this dye liquor at 60° C (liquor ratio 1:20). The liquor is heated in the course of 30 minutes to 130° C and dyeing is performed for a further 30 minutes at this temperature. The material is rinsed as described in Example 1. It is dyed a strong blue shade with a colour strength of 400%, whereas the colour strength is only 100% if dyeing is effected under identical conditions with a dye liquor that does not contain dibutylnaphthalene sulphonate.

EXAMPLE 4

Textile material of aromatic polyamides is put at 50° C into a dye liquor that contains 10 g/l of a carrier mixture of Example 1 and 2 g/l of dioctyl sulphosuccinate and the pH of which is adjusted to 3 with formic acid (liquor ratio 1:20). The liquor is subsequently heated to 80° C in the course of 30 minutes and dyeing is performed for a further 60 minutes at this temperature. The material is rinsed as described in Example 1 and is dyed a strong blue shade with a colour strength of 220%. A dyed textile material with a colour strength of 100% is obtained by carrying out the above procedure, but using a dye liquor without dioctyl sulphosuccinate.

EXAMPLES 5 TO 14

The dyes listed in column 2 of the following table are substituted for the dyes used in Examples 1 to 4. The same procedure is carried out to yield textile material which has a colour strength of at least 200% and is dyed in the shades indicated in column 3 of the table.

Table

| Ex. | Dye | Shade |
|---|---|---|
| 5 | 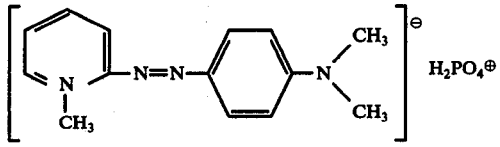 | violet |

Table-continued
| Ex. | Dye | Shade |
|---|---|---|
| 6 | 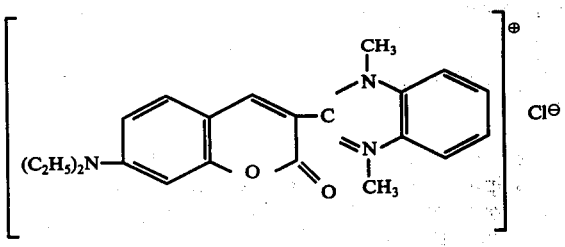 | yellow |
| 7 | 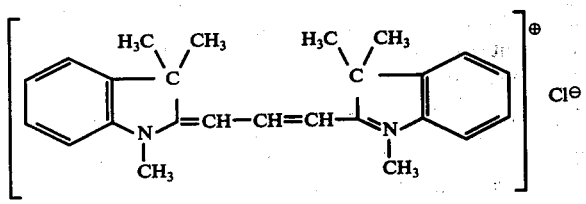 | red |
| 8 | 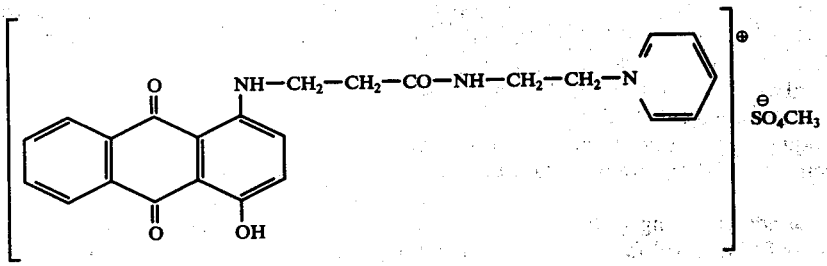 | blue |
| 9 | 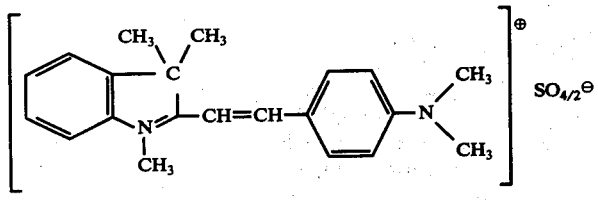 | red |
| 10 | 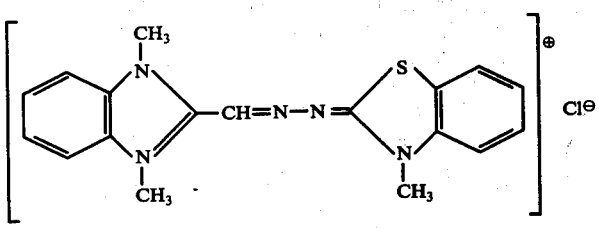 | orange |
| 11 | 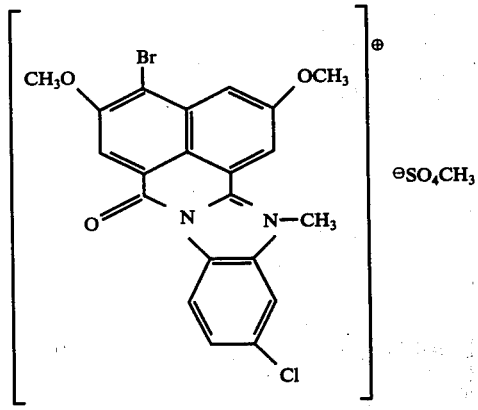 | yellow |

Table-continued

| Ex. | Dye | Shade |
|---|---|---|
| 12 | 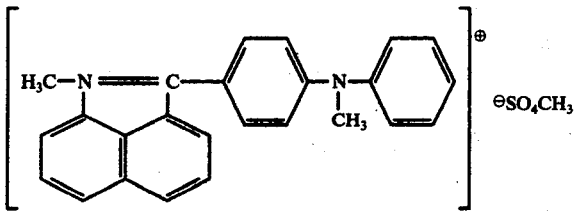 | blue |
| 13 | 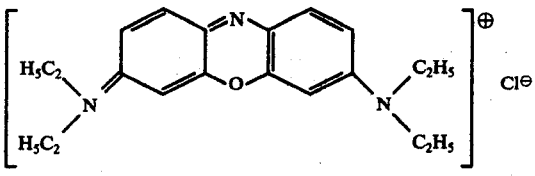 | blue |
| 14 | 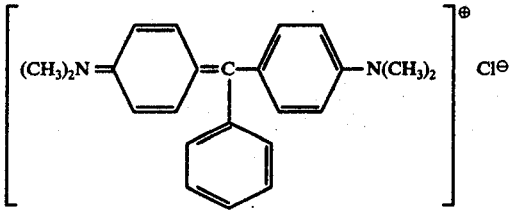 | green |

We claim:

1. In a process for dyeing or printing aromatic polyamide fibers with a dye liquor comprising a cationic dye, water, and a non-ketonic carrier in an amount of 5 to 30 grams per liter of dye liquor, the improvement which comprises further including in the dye liquor 0.1 to 5 g. per liter of an anionic assistant selected from the group consisting of a sulfonated fatty alcohol of 8 to 22 carbon atoms, a sulfonated alkylnaphthalene containing an alkyl group of 8 to 22 carbon atoms, a sulfosuccinic acid alkyl ester containing an alkyl group of 8 to 22 carbon atoms, a dodecyldiphenyl ether disulfonic acid, a sulfonated castor oil, and dinitrobenzenesulfonate, as the free acid or as the alkali metal, ammonium or amine salt.

2. The process of claim 1, wherein the dyeing is carried out by exhaustion.

3. The process of claim 1, wherein the dyeing is carried out at a temperature of 50 to 140° C.

4. The process of claim 3, wherein the temperature is in the range of 80 to 98° C.

5. The process of claim 1, wherein the carrier is an aromatic carboxylic acid ester.

6. The process of claim 1, wherein the carrier is a glycol ether of the formula $$R-O\left(CH_2-\underset{\underset{Z}{|}}{CH}-O\right)_n-H$$

wherein R is phenyl or chlorophenyl, Z is hydrogen or methyl, and $n$ is 1 to 3, and wherein each Z is independently hydrogen or methyl where $n$ is 2 or 3.

7. The process of claim 5, wherein the carrier further comprises benzyl alcohol.

8. The process of claim 5, wherein the carrier is the reaction product of an average of 1 mole of ethyleneoxide per one mole of a mixture of 20% by weight of o-chlorophenol and 80% by weight of p-chlorophenol.

9. The process of claim 1, wherein the anionic assistant is an amine salt of a sulfonated long-chain fatty alcohol.

10. The process of claim 1, wherein the anionic assistant is dibutylnaphthalene sulfonate.

11. The process of claim 1, wherein the anionic assistant is dodecyl-diphenylether disulfonate.

12. The process of claim 1, wherein the anionic assistant is dioctyldisulfosuccinate.

13. The process of claim 1, wherein the anionic assistant is sulfonated castor oil.

14. A dye liquor or printing paste for dyeing or printing aromatic polyamide fibers comprising a cationic dye, water, non-ketonic carrier in an amount of 5 to 30 grams per liter and 0.1 to 5 grams per liter of an anionic assistant selected from the group consisting of sulfonated fatty alcohol of 8 to 22 carbon atoms, a sulfonated alkylnaphthalene containing an alkyl group of 8 to 22 carbon atoms, a dodecyl-diphenyl ether disulfonic acid, a sulfonated castor oil, and dinitrobenzenesulfonate, as the free acid or the alkali metal, ammonium or amine salt.

15. Aromatic polyamide fibers dyed or printed by the process of claim 1.

* * * * *